United States Patent [19]

Kaiser

[11] Patent Number: 4,633,164

[45] Date of Patent: Dec. 30, 1986

[54] MICROPROCESSOR CONTROLLED CONSTANT CURRENT CIRCUIT

[75] Inventor: Donald F. Kaiser, Parsippany, N.J.

[73] Assignee: Beckman Industrial Corporation, Cedar Grove, N.J.

[21] Appl. No.: 811,405

[22] Filed: Dec. 20, 1985

[51] Int. Cl.[4] ..... G05F 3/24

[52] U.S. Cl. ..... 323/312; 340/347 DA

[58] Field of Search ..... 340/347 DA; 323/311, 323/312, 317, 351

[56] References Cited

U.S. PATENT DOCUMENTS

| | | | |
|---|---|---|---|
| 3,258,765 | 6/1966 | Battjes | 340/347 DA |
| 3,512,000 | 5/1970 | Powell | 307/117 |
| 3,867,641 | 2/1975 | Collins | 307/117 |
| 4,547,762 | 10/1985 | Ono | 340/347 DA |

FOREIGN PATENT DOCUMENTS

| | | | |
|---|---|---|---|
| 45841 | 2/1982 | European Pat. Off. | 323/311 |

*Primary Examiner*—William H. Beha, Jr.

*Attorney, Agent, or Firm*—Daniel H. Bobis

[57] ABSTRACT

Apparatus for generating a constant current, comprising a storage device for storing a voltage corresponding to the constant current, the storage device including a resistor-capacitor filter and having an input and an output; a Zener diode for supplying a constant voltage; a first high off-state impedance device for connecting the Zener diode to the input in response to a first actuation signal; a second high off-state impedance device for connecting the input to a source of discharge potential in response to a second actuation signal; a microprocessor for supplying the first actuation signal to the first high off-state impedance device for a first time interval and the second actuation signal to the second off-state impedance device thereafter for a second time interval, and then providing no first and second actuation signals for a third time interval much greater than the combined first and second time intervals; and a voltage-to-current converting circuit connected to the output and having a high input impedance, for converting the voltage stored in the storage device to the constant current.

16 Claims, 2 Drawing Figures

MICROPROCESSOR CONTROLLED CONSTANT CURRENT CIRCUIT

BACKGROUND OF THE INVENTION

This invention relates generally to constant current circuits and, more particularly, is directed to a microprocessor controlled constant current circuit.

Circuits which generate a constant current are well known in the art. However, such circuitry is relatively complex. In addition, such known circuitry is continuously operative, thereby having a relatively large power requirement.

In many instances, however, it is necessary to provide an isolated output current for use with microprocessor-based instrumentation, which circuitry is accurate, compact and inexpensive. For example, for use with microprocessor-based process pH and conductivity monitoring instrumentation, such as that sold by Beckman Industrial Corporation of Cedar Grove, N.J., it is necessary to provide an isolated output current in the range of 4–20 mA. Since the microprocessor controls many other operations of the apparatus, it cannot be used to continuously monitor and adjust the required output current, without detracting from the other operations it must perform. Therefore, to prevent this result, the circuitry must be made more complex.

U.S. Pat. No. 3,646,650 discloses a circuit in which, when no signal is received by the receiver, a transistor is normally turned ON which passes a low impedance to the gate of a SCR, thereby maintaining the SCR in an OFF state. Under such conditions, the output of a bridge rectifier charges a capacitor through a diode. A Zener diode regulates the power supplied to the capacitor. When a proper signal is received by the receiver, the transistor is turned OFF so that the SCR is controlled by the voltage across a resistor. In this mode, the SCR is operated to provide a constant current. In addition, the SCR produces a high impedance in its OFF condition. See also, U.S. Pat. Nos. 3,867,641 and 3,512,000.

OBJECTS AND SUMMARY OF THE INVENTION

Accordingly, it is an object of the present invention to provide a microprocessor controlled constant current circuit in which the microprocessor is operative over a relatively small period of time to maintain the constant current.

It is another object of the present invention to provide a microprocessor controlled constant current circuit that is accurate, compact, and inexpensive to manufacture and use.

In accordance with an aspect of the present invention, apparatus for generating a constant current, includes storage means for storing a voltage corresponding to the constant current, and having an input and an output; constant voltage supply means for supplying a constant voltage; first high off-state impedance means for connecting the constant voltage supply means to the input in response to a first actuation signal; second high off-state impedance means for connecting the input to discharge means in response to a second actuation signal; actuation means for supplying the first actuation signal to the first high off-state impedance means and the second actuation signal to the second high off-state impedance means thereafter; and voltage-to-current conversion means connected to the output and having a high input impedance, for converting the voltage stored in the storage means to the constant current.

The above and other, objects, features and advantages of the present invention will become readily apparent from the following detailed description thereof which is to be read in connection with the accompanying drawings.

DETAILED DESCRIPTION OF A PREFERRED EMBODIMENT

Figure 1:
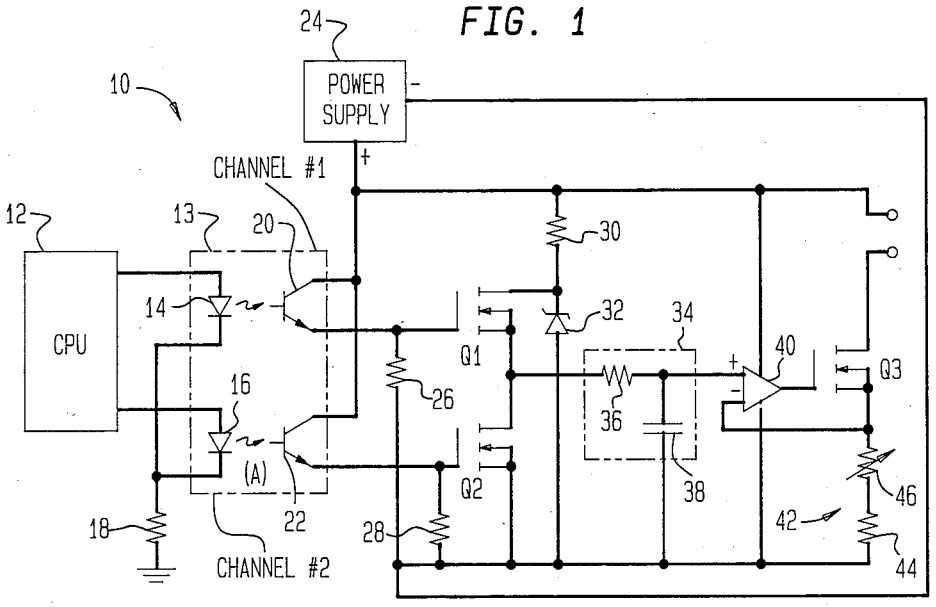
FIG. 1 is a circuit wiring diagram of a microprocessor controlled constant current circuit according to the present invention.

Referring to the drawings in detail, and initially to FIG. 1 thereof, a microprocessor controlled constant current circuit 10 according to the present invention uses a microprocessor or central processing unit (CPU) 12 which is used in an instrument, such as a pH and conductivity instrument, to control various operations, including the constant current generating operation. CPU 12 is connected to an opto-isolator 13, and specifically, to one end of a first light emitting diode (LED) 14 and separately to one end of a second light emitting diode (LED) 16 which form part of opto-isolator 13. The opposite ends of LEDs 14 and 16 are connected to ground through a resistor 18.

LED 14 is operatively associated with a first phototransistor 20 which converts light received from first LED 14 to an electrical signal. In like manner, second LED 16 is associated with a second phototransistor 22 which converts light received from second LED 16 to an electrical signal. Phototransistors 20 and 22 also form part of opto-isolator 13. The positive terminal of a power supply 24 is connected to the collectors of phototransistors 20 and 22 for supplying an operating voltage thereto, and the emitters of phototransistors 20 and 22 are connected through resistors 26 and 28, respectively, to the negative terminal of power supply 24, or alternatively, to ground.

It will be noted that opto-isolator 13 performs the important function of providing a high level of voltage isolation between the instrument and the constant current circuit 10.

The emitter of phototransistor 20 is also connected to the gate of a first high off-state impedance MOSFET Q1, the drain of which is connected to the positive terminal of power supply 24 through a resistor 30. In like manner, the emitter of phototransistor 22 is connected to the gate of a second high off-state impedance MOSFET Q2, having its drain connected to the source of first MOSFET Q1 and its drain connected to the negative terminal of power supply 24. A Zener diode 32 is connected between the drain of first MOSFET Q1 and the negative terminal of power supply 24.

A storage circuit 34 for storing a constant voltage corresponding to a desired constant current includes a resistor 36 having one end connected to the junction of the source of first MOSFET Q1 and the drain of second MOSFET Q2, which constitutes an input to storage circuit 34. Storage circuit 34 also includes a capacitor 38 having one end connected to the opposite end of resistor 36, which junction constitutes the output of storage circuit 34, and the opposite end of capacitor 38 connected to the negative terminal of power supply 24.

The output of storage circuit 34 at the junction of resistor 36 and capacitor 38 is connected to the positive input of an operational amplifier 40, the negative input being connected to the negative terminal of power supply 24 through a potentiometer 42 including a fixed resistor 44 and a series connected variable resistor 46. The output of operational amplifier 40 is connected to the gate of a third MOSFET Q3 having its source connected to the negative input of operational amplifier 40 and its drain operative as the output of microprocessor controlled constant current circuit 10 at which the constant current is produced. Operational amplifier 40 and third MOSFET Q3 form a voltage-to-current converter which generates a current proportional to the voltage supplied thereto.

Figure 2:
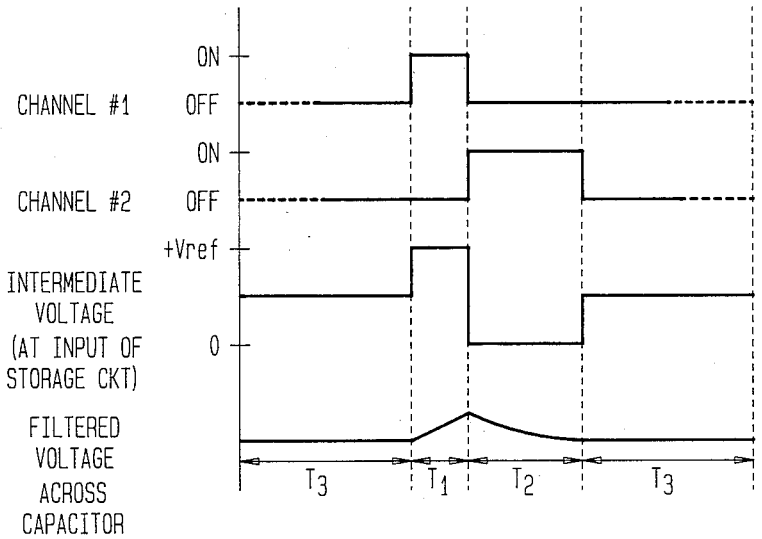
FIG. 2 is a waveform diagram used for explaining the operation of the circuit of FIG. 1.

The circuit of FIG. 1 is designed to generate a continuous output current directly proportional to a binary number V in the range 0 to N. Specifically, CPU 12 first calculates two time values as follows:

$$T_1 = V/N \cdot K \tag{1}$$

$$T_2 = (N - V/N) \cdot K \tag{2}$$

where K is a proportionality constant chosen to confine $T_1$ and $T_2$ within a preselected time range. For example, a typical value for K for generating a current in the range of 4–20 mA is 1–10 msec. CPU 12 then switches channel 1 of optically coupled isolator 13 for an interval $T_1$ in duration. Specifically, first LED 14 generates a light input for the time interval $T_1$. In response thereto, phototransistor 20 is turned ON which, in turn, turns ON first MOSFET Q1. As a result, Zener diode 32 is connected to the input of storage circuit 34. Thus, a voltage, determined by Zener diode 32, is supplied to the input of storage circuit 34, whereby capacitor 38 charges during such time interval $T_1$, as indicated in FIG. 2. At the end of time interval $T_1$, first MOSFET Q1 is turned OFF, whereby the supply voltage to capacitor 38 is cut off.

Immediately thereafter, CPU 12 switches ON channel 2 for a time interval $T_2$ in duration. Specifically, LED 16 turns ON phototransistor 22 for the time interval $T_2$. Phototransistor 22, in turn, turns on second MOSFET Q2 for the same time interval. As a result, storage circuit 34 is connected to ground (or the negative terminal power supply 24), whereby capacitor 38 is caused to discharge through second MOSFET Q2 as shown in FIG. 2.

At the end of time interval $T_2$, both channels 1 and 2 are maintained in an OFF mode for a time interval $T_3 >> T_1 + T_2$. The exact length of time interval $T_3$ is unimportant, although it is important that this time interval may be allowed to be much greater than the aforementioned time intervals to permit the microprocessor to execute other tasks typically required in process control instrumentation, without tying up the microprocessor.

In accordance with the present invention, storage circuit 34, which is a resistor-capacitor filter, is designed to have a time constant T as follows:

$$T = \frac{1}{RC} >> T_1 + T_2 \tag{3}$$

It will be appreciated that capacitor 38 is not charged to the desired voltage immediately. Rather, this occurs after many cycles of time intervals $T_1$, $T_2$ and $T_3$. Thus, it takes a number of such cycles to charge capacitor 38 to the set level. Thereafter, during each successive cycle, capacitor 38 is charged during time interval $T_1$ and discharges slightly during each time interval $T_2$ to the desired voltage. Thus, after many cycles, capacitor 38 is charged to a voltage $V_O$ as follows:

$$V_0 = \frac{T_1 \times (\text{Voltage Reference})}{T_1 + T_2}, \tag{4}$$

where the voltage reference is determined by Zener diode 32. Equation (4) is related to the original number V ($O \leqq V \leqq N$) set by CPU 12 as follows:

$$V_0 \times \frac{V \times (\text{Voltage Reference})}{N}. \tag{5}$$

The inherently high off-state impedance of MOSFETs Q1 and Q2, and the high input impedance of operational amplifier 40, prevent the output voltage $V_O$ across capacitor 38 from changing significantly during time interval $T_3$.

In this manner, a constant voltage, as controlled by the microprocessor using time intervals $T_1$ and $T_2$, is obtained at the positive input of operational amplifier 40. This constant voltage is then translated to a constant current by operational amplifier 40, MOSFET Q3 and resistors 44 and 46.

Thus, a constant output current is obtained, the value of which is only dependent on the relationship, that is, relative time periods, between $T_1$ and $T_2$.

It will be appreciated that circuit 10 provides distinct advantages. Specifically, circuit 10 may be used to generate high accuracy, high precision output signals using relatively simple and inexpensive circuitry. Further, circuit 10 requires less intervention by the microprocessor than would be achieved, for example, by a conventional pulse width modulation circuit which requires continuous application of control signals in order to maintain output signal integrity. Thus, long periods of time ($T_3$) may be allowed to pass during which no control signal is applied to the circuit, without losing the integrity of the output signal. Further, the use of a power supply which is isolated from the microprocessor, results in a high degree of isolation between the input and the output which may easily be obtained using commonly available optically coupled isolators.

Having described a specific preferred embodiment of the invention with reference to the accompanying drawings, it will be appreciated that the present invention is not limited to that precise embodiment, and that various changes and modifications may be effected therein by one of ordinary skill in the art without departing from the scope or spirit of the invention as defined by the appended claims.

What is claimed is:

1. Apparatus for generating a constant current, comprising:

storage means for storing a voltage corresponding to said constant current, and having an input and an output;

constant voltage supply means for supplying a constant voltage;

first high off-state impedance means for connecting said constant voltage supply means to said input in response to a first actuation signal;

second high off-state impedance means for connecting said input to discharge means in response to a second actuation signal;

actuation means for supplying said first actuation signal to said first high off-state impedance means and said second actuation signal to said second high off state impedance means thereafter; and voltage-to-current conversion means connected to said output and having a high input impedance, for converting said voltage stored in said storage means to said constant current.

2. Apparatus according to claim 1; wherein said actuation means includes a microprocessor for producing said first actuation signal and said second actuation signal, first switch means for supplying said first actuation signal to said first high off-state impedance means and second switch means for supplying said second actuation signal to said second high off-state impedance means.

3. Apparatus according to claim 2; wherein said first switch means is an opto-isolator which includes first light transmitting semiconductor means for producing a first light signal in response to said first actuation signal and first light receiving semiconductor means for receiving said first light signal and reproducing said first actuation signal in response thereto.

4. Apparatus according to claim 3; wherein said first light transmitting semiconductor means includes a light emitting diode and said first light receiving semiconductor means includes a phototransistor.

5. Apparatus according to claim 3; wherein said second switch means is an opto-isolator which includes second light transmitting semiconductor means for producing a second light signal in response to said second actuation signal and second light receiving semiconductor means for receiving said second light signal and reproducing said second actuation signal in response thereto.

6. Apparatus according to claim 5; wherein said second light transmitting semiconductor means includes a light emitting diode and said second light receiving semiconductor means includes a phototransistor.

7. Apparatus according to claim 1; wherein said first high off-state impedance means includes a first MOSFET having a gate terminal supplied with said first actuation signal, a drain terminal connected to a power supply and a source terminal connected to said input of said storage means.

8. Apparatus according to claim 7; wherein said constant voltage supply means includes a Zener diode connected to said drain terminal.

9. Apparatus according to claim 7; wherein said second high off-state impedance means includes a second MOSFET having a gate terminal supplied with said second actuation signal, a drain terminal connected to said input of said storage means and a source terminal connected to a source of discharge potential.

10. Apparatus according to claim 1; wherein said second high off-state impedance means includes a MOSFET having a gate terminal supplied with said second actuation signal, a source terminal connected to a source of discharge potential and a drain terminal connected to said input of said storage means.

11. Apparatus according to claim 1; wherein said storage means includes a resistor-capacitor filter including a resistor connected in series between said input and said output and a capacitor connected between said output and a source of discharge potential.

12. Apparatus according to claim 1; wherein said voltage-to-current conversion means includes an operational amplifier having an input connected to said storage means and an output, and transistor means having an input connected to said output of said operational amplifier and an output at which said constant current is produced.

13. Apparatus according to claim 12; wherein said transistor means includes a MOSFET having a gate terminal connected to said output of said operational amplifier and a drain terminal which constitutes said output of said transistor means.

14. Apparatus for generating constant current, comprising:

storage means for storing a voltage corresponding to said constant current, said storage means including a resistor-capacitor filter and having an input and an output;

Zener diode means for supplying a constant voltage;

first high off-state impedance means for connecting said Zener diode means to said input in response to a first actuation signal;

second high off-state impedance means for connecting said input to discharge means in response to a second actuation signal;

microprocessor means for supplying said first actuation signal to said first high off-state impedance means for a first time interval and said second actuation signal to said second off-state impedance means thereafter for a second time interval, and then inhibiting the supply of said first and second actuation signals for a third time interval much greater than the combination of said first and second time intervals; and voltage-to-current conversion means connected to said output and having a high input impedance, for converting said voltage stored in said storage means to said constant current.

15. Apparatus according to claim 14; wherein said first high off-state impedance means includes a MOSFET having a gate terminal supplied with said first actuation signal, a source terminal connected to said input of said storage means and a drain terminal connected to said Zener diode means for supplying said constant voltage to said storage means during said first time interval.

16. Apparatus according to claim 14; wherein said second high off-state impedance means includes a MOSFET having a gate terminal supplied with said first actuation signal, a source terminal connected to a source of discharge potential and a drain terminal connected to said input of said storage means for discharging said capacitor during said second time interval.

* * * * *

UNITED STATES PATENT AND TRADEMARK OFFICE

CERTIFICATE OF CORRECTION

PATENT NO. : 4,633,164

DATED : December 30, 1986

INVENTOR(S) : Donald F. Kaiser

It is certified that error appears in the above-identified patent and that said Letters Patent is hereby corrected as shown below:

Column 3, line 24, (equation 2), delete:

" $T_2 = (N - V/N) \cdot K$ " and insert therefore:

-- $T_2 = \frac{N - V}{N} \cdot K$ --.

Column 4, line 16, delete:

" $V_o \times V \times \frac{\text{(Voltage Reference)}}{N}$ " and insert therefore:

-- $V_o = V \times \frac{\text{(Voltage Reference)}}{N}$ --.

Signed and Sealed this

Eleventh Day of April, 1989

*Attest:*

DONALD J. QUIGG

*Attesting Officer*

*Commissioner of Patents and Trademarks*